US005666739A

United States Patent [19]

Krueger

[11] Patent Number: 5,666,739

[45] Date of Patent: Sep. 16, 1997

[54] ENERGY CONSERVATION COUPLER

[76] Inventor: Waldemar Krueger, 75 Main St., Paris, Ontario, Canada, N3L 1E7

[21] Appl. No.: 284,937

[22] Filed: Aug. 2, 1994

[51] Int. Cl.[6] ..... F27B 7/36

[52] U.S. Cl. ..... 34/86; 34/90; 34/513

[58] Field of Search ..... 34/86, 90, 91, 34/513, 514, 515

[56] References Cited

U.S. PATENT DOCUMENTS

| | | | |
|---|---|---|---|
| 2,229,559 | 1/1941 | Fox | 34/90 |
| 4,034,482 | 7/1977 | Briscoe | 34/513 |
| 4,137,645 | 2/1979 | Bullock | 34/513 |
| 4,205,456 | 6/1980 | Ayers | 34/515 |
| 4,270,282 | 6/1981 | Lotz | 34/514 |
| 4,279,082 | 7/1981 | Commander | 34/86 |
| 4,873,773 | 10/1989 | Canonge | 34/90 |
| 5,343,632 | 9/1994 | Dinh | 34/86 |

FOREIGN PATENT DOCUMENTS

| | | | |
|---|---|---|---|
| 0108060 | 8/1979 | Japan | 34/86 |
| 3140248 | 6/1988 | Japan | 34/86 |
| 2147400 | 5/1985 | United Kingdom | 34/515 |

*Primary Examiner*—Carl S. Miller

[57] ABSTRACT

The electric clothes dryer is a valuable convenience appliance in our life style. For half of a century its usefulness has been enjoyed through the availability of inexpensive electric energy. But, it is a wasteful energy device. Not much has been done to correct this shortcoming. I feel there is a great need to approach energy conservation with an open mind to alternatives which may be easily available to us. I have invented a unique and novel approach to using heated air which is conveniently available in a large percentage of our homes. The source, for this application, has never been tapped. In the U.S. and Canada as needed by climate conditions, we use a range of central air heating and cooling systems. My invention makes possible a transfer of heat from these systems to operate electric clothes dryers with a majority situation of no heat energy cost.

5 Claims, 4 Drawing Sheets

SECTION 1-1

ENERGY CONSERVATION COUPLER

BACKGROUND OF THE INVENTION

The invention relates to a method of conservation of energy in that it displaces the need to electrically heat the drying air of an electric clothes dryer and reduces energy consumption or waste in associated areas.

DESCRIPTION OF THE PRIOR ART

The invention deals with the excessive use of electrical in the operation of electric clothes dryers, with the intent to displace the necessity of electrically heating the dryer air with which to dry clothing in electric clothes dryers. To the best of my ability, I have been unable to find prior art referring to the use of independent or unrelated hot air sources to offset this electrical heating of air. I also have not found any reference to cost-free sources of such hot air supplies.

OBJECTS AND ADVANTAGES

Accordingly, several objects and advantages of my invention are:

My invention to a great extent helps to overcome the wasteful use of electric energy by electric clothes dryers. In a very simple approach my invention makes it possible to control the introduction of warm or hot air from a home central air heating or cooling system into the dryer. My invention under optimum conditions can control the operation of an electric clothes dryer without using any electric heat energy at all to perform a normal clothes drying function. The only electrical input to the dryer is to operate the drum-and-blower motor and this is only five per-cent of the dryer's input rating.

A normal electric dryer operation takes in ambient home air, heats it, humidifies it, and exhausts it to the outdoors as waste.

Then the exhausted air must be replaced into the indoors by air infiltration. If the outdoor temperature is cold this air must be heated, and if the outdoor temperature is hot the air must be cooled. These amounts of air exchange and heat exchange are very significant. In the case of an air-conditioned home the air exchange involves one extra step. The home's cooling process takes the air from a hot outdoor to a cool indoor temperature. Then it is actually reheated to the outdoor level again, and then more heat is used to reach the needed drying temperature. This extra drop and raising of temperature adds a nearly fifty per-cent of cost to the drying process. Dropping the temperature is done at a three-to-one power advantage by the air conditioner, but heating is by full electric cost in the dryer.

My invention uses waste heat from the outdoor heat exchanger air conditioning system. It involves the installation of a small hood of appropriate design and placement of a duct to carry heat into the invention from which it is directed to the dryer. In the dryer the air picks up moisture from the clothing and then it is exhausted by way of my invention to the outdoors. In this process no air is taken from the home environment. So no air needs to be replaced with the resulting energy losses. So this whole process of using the waste air has more benefit than was even previously considered. Even if the air conditioner is not working the dryer could be used with its electric heating elements with outdoor ambient air coming into the dryer and doing the electric drying and exhausting to the outdoors.

In borrowing furnace hot air and using it to dry (see the total explanation in the invention operation section) no energy heat costs are incurred and the home's ambient air is undisturbed by not exhausting the dryer to the outdoors.

In either the furnace or the air conditioner waste heat use there could be times when the drying process is not fast enough for the user. In such a case the dryer can be used with electric heating. While using the furnace air the heating cycles could on a warm day become too infrequent. So by using the electric elements the user can revert to electrical use. But if and when the furnace did enter a heat cycle the invention would provide the furnace heated air as a hot ambient supply to the dryer. This would reduce or even cut to zero the electric input and thereby still save on electric energy use. My invention is perfectly compatible with such a combination of usage. In fact my invention allows the retention and use of all the design features and capabilities of any electric dryer. My invention does not interfere with a dryer in any way. My invention is added purely as an asset.

BRIEF DESCRIPTION OF THE DRAWINGS

In drawings which illustrate embodiments of the invention.

DETAILED DESCRIPTION OF THE PREFERRED EMBODIMENTS

Figure 1:
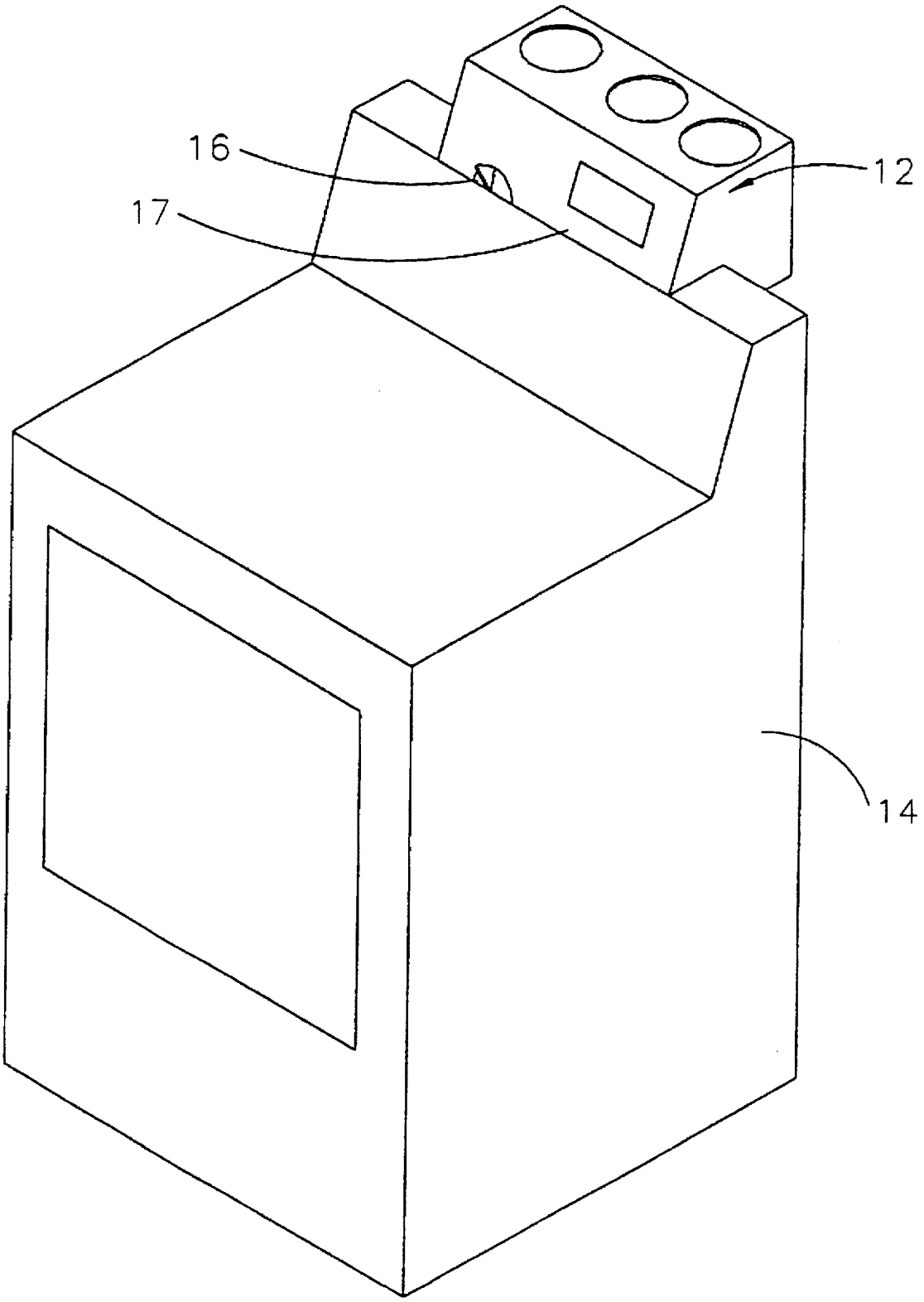
FIG. 1 is an isometric view showing the invention as it would appear when mounted on a conventional electric clothes dryer.

FIG. 1 in an isometric view shows the invention 12 as it would appear mounted on a conventional electric clothes dryer 14. The invention is very light in weight at about four pounds. It is simply and quickly mountable to the rear wall of the dryer. Using a template for accuracy three shoulder studs are mounted into the dryer. The invention has three corresponding inverted key-holes. The invention is placed using the key-holes onto the studs and snapped down over them for a secure fastening.

Figure 2:
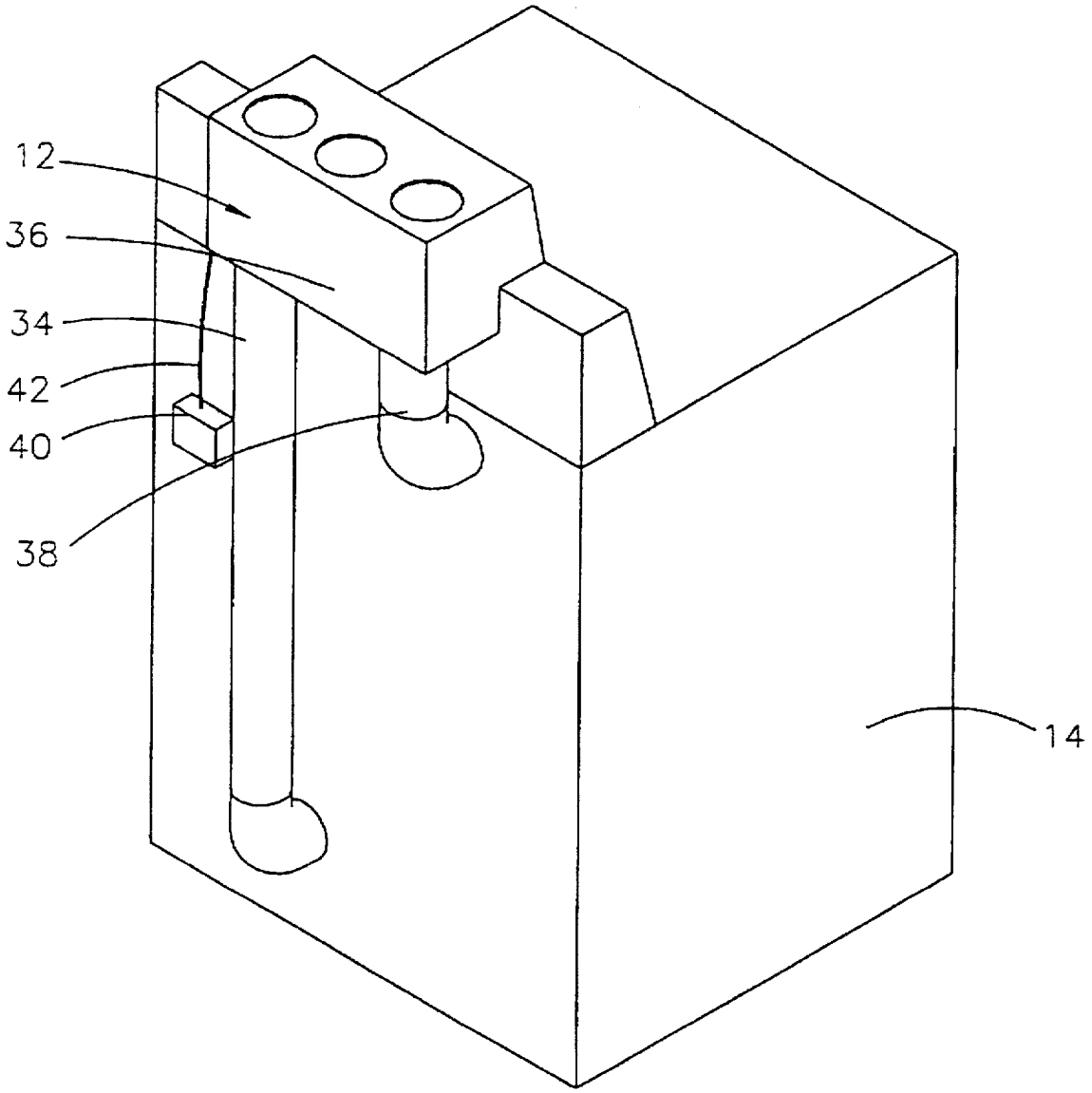
FIG. 2 is an isometric view illustrating the rear of the dryer and the invention.

FIG. 2 shows the rear of the invention-to-dryer assembly. Also shown is a flexible duct 38 which carries hot air supply to dryer 14. Also a duct 34 from the base area of dryer 14 to an entry 64 in the bottom of invention 12.

A power pack 40 contains a 120 volt to 12 volt alternating current transformer and a rectifier for the 12 volt direct current supply needed for the electronic controller. It also contains a dual solid state relay requiring 12 volt direct current gate actuation. This relay controls the dryer motor on/off switching at 120 volts AC. The power pack also has a single solid state relay for series switching of the dryer's temperature setting control. An electronic controller 18-A is mounted to a control panel face-plate 17. Controller 18-A is programmed by keypad buttons 18-C and this action is displayed by a liquid crystal display 18-B The hot air into the invention enters a first inlet 20 from a flexible duct fastened to rim 22 with a quick connect clamp. Rim 22 and rim 24 provide fastening for two flex exhaust ducts.

Figure 3:
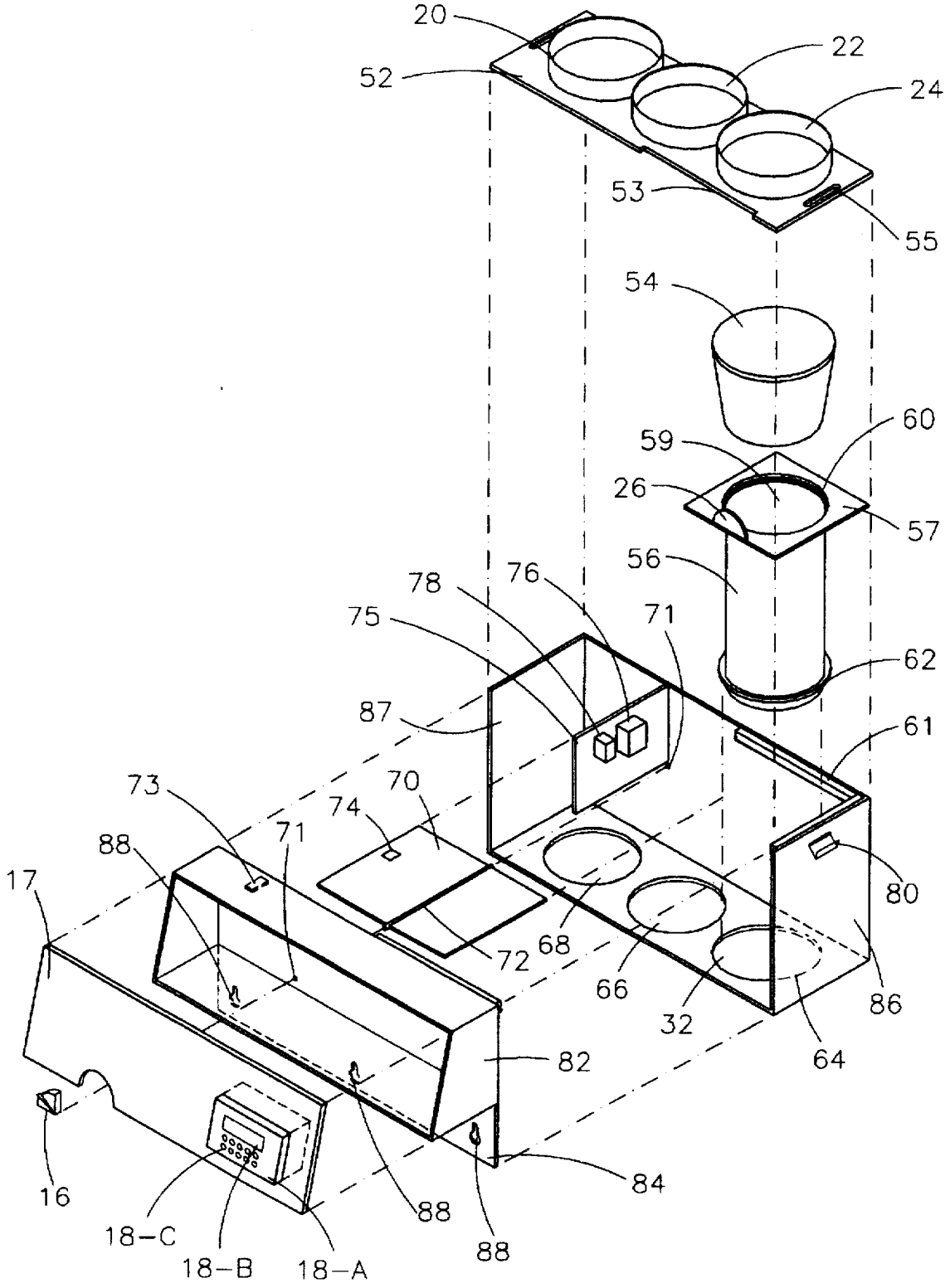
FIG. 3 is an exploded isometric view showing all the main details of the invention.

In FIG. 3 all of the components are revealed in an exploded view. A lid 52 is shown to have a cut-away area on its front edge. This forms a slot 53 and permits protrusion of tab 26 above the surface of lid 52. A sliding plate 57 allows centering of the flexible internal exhaust duct 56 for centering under either exhaust rim 24 or exhaust rim 22. A plastic tubular rim 62 is fused to the bottom end of duct 56 and protrudes and is cemented through the inlet opening 64. This permits the exhaust duct 34 to be assembled to rim 62 using a circular fastening clamp. A track 61 and a second track 63, one on either side of the upper wall areas of a body housing 86, carry plate 57 and permit its lateral centering movements. A filter 54 hangs by its upper rim into a recessed formed edge around a hole 59 of plate 57.An electromagnet 76 is mounted with its magnetic tip protruding through a wall 75 and into a damper housing 87. A switch 78, actually the manual startup switch, is mounted on wall 75. A thermistor heat sensor 73 is mounted with its sensing tip in face plate 84. A damper plate 70 with a mounting shaft 72 and a magnetic-steel insert 74 is mounted through lateral body nylon bushes. A hook type clamp 80 is used at each end of the body housing 86 to extend upward and over lid 52 and grip into a groove 55 at each end of lid 52 for positive assembly.

Figure 4:
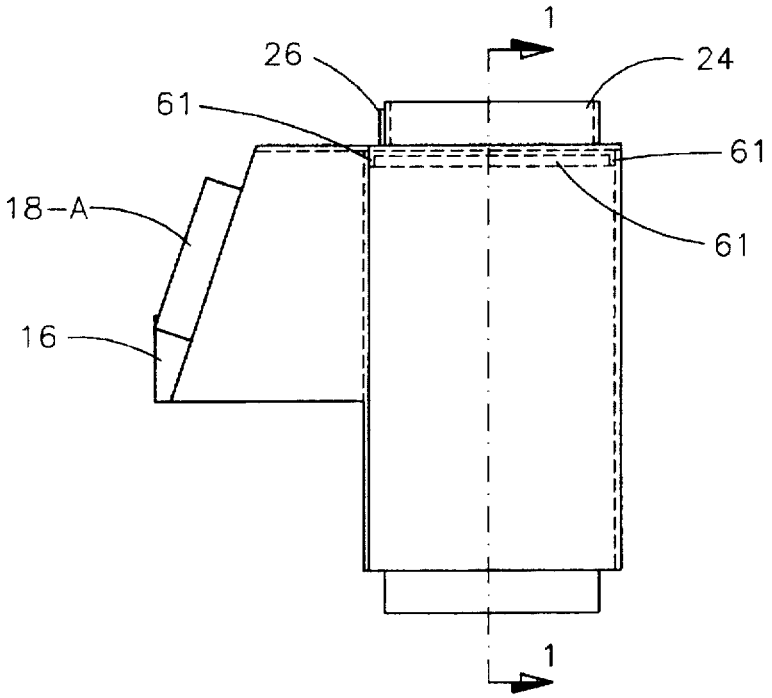
FIG. 4 is an end view elevation showing the section plane for FIG. 5.
Figure 5:
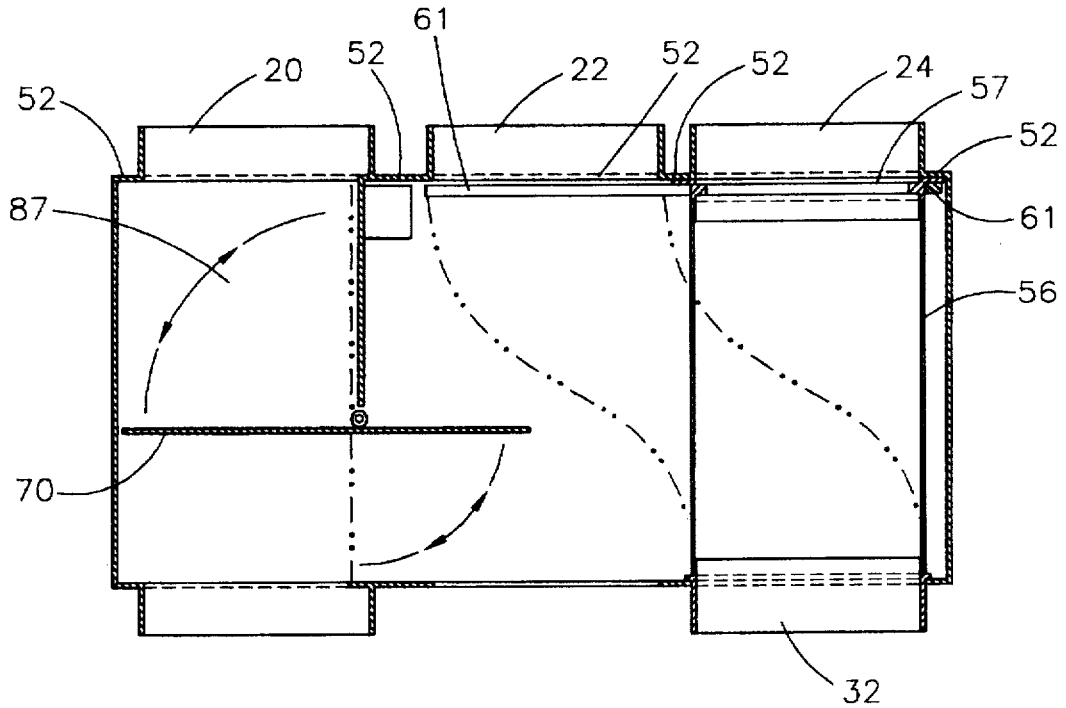
FIG. 5 is a longitudinal section taken through the center line of the invention's air inlets and outlets to depict operational variations.

FIG. 4 is an end elevation only to indicate the FIG. 5 section plane. The prior isometric views did not lend well for this sectional indication.

FIG. 5 shows that damper 70 is in its normal position. A phantom line shows damper 70 in vertical position. Note the off-centered construction of damper 70 and shaft 72. Internal duct 56 is shown in its vertical position to allow exhaust through rim 24 which would be the outdoor exhaust position. Phantom lines show duct 56 centered under rim 22 which would allow exhaust to return to the furnace.

Operation of the Device

The invention uses the available borrowed heat to dry the clothing inside an electric dryer without using the dryer's heating elements.

A home's central heating air furnace system is a possible source. The furnace takes in cool air heats it and circulates it through the home's interior. This heating cycle goes on as needed to heat and to maintain the preset warmth of a home.

An electric clothes dryer draws in relatively cool ambient air from its immediate surroundings and electrically heats it. The dryer's blower continues to suck the heated air through the clothing to dry the clothing, then the blower exhausts the somewhat cooled and moisture-added air through a duct and expels it outdoors as waste.

If we now combine the functions of the furnace and the dryer we arrive at a combination which provides large energy savings.

The dryer must be controlled so that it can be operated with its elements off. Also, the motor which rotates the drum and blower must be controlled to operate only while the furnace is in a heating cycle. A small amount of the furnace output of hot air can be directed to an inlet in the dryer. The dryer will dry the clothing and will exhaust the waste heat and moisture. Instead of exhausting the air to the outdoors, this valuable warm moist air will go to the furnace cold air return duct and back into the home's hot air circulation.

So in review, the furnace circulates hot air and the dryer borrows a small amount to dry the clothing, and returns all of the borrowed heat to the home. No dryer air is exhausted to the outdoors. No heat is lost from the home. Even the latent heat used to evaporate water is retained in the vapor and returned to the home along with a clean humidifying source as an added benefit. No electric heated air is used by the dryer, so there is no electric heating cost by the dryer. The clothing dries and the home is very slightly humidified with the average three pounds of water per dryer load. We also have yet another energy benefit, since no air was exhausted to the outdoors by the dryer at its blower output rate of approximately six thousand cubic feet per hour the furnace was relieved of heating the replacement six thousand cubic feet per hour of outdoor air that would have infiltrated to replace the exhaust, as would have been the case with a standard electric dryer's operation.

In the case of a furnace heat source:

From the user's approach the dryer is loaded and the program controller for the dryer is set to the off position. The dryer is now ready to operate in its off mode but with using furnace heat. The invention must now be set for furnace operation. The start knob 16 is turned to its on position as marked. This action of turning the switch on is a ninety degree rotation of the damper shaft 72. This of course rotates the damper 70 from its horizontal normally off position to its heat operating vertical position. The hot air can now pass vertically downward and through the invention and down into the dryer. Knob 16 when rotated to its on position and moving the damper 70 to its vertical position moves the damper against the wall 75. Here the plate depresses a double pole single throw microswitch 78. Closing this switch energizes the total circuit of controller 18-A in a latching switch mode. This is done by one pole of switch 78, while the other pole independently energizes the electromagnet 76. The magnetic steel insert 74 in the damper 70 contacts with magnet 76. The magnet now being energized will firmly retain damper 70 in the vertical position. The liquid crystal display 18-B now prompts the operator to program the time in minutes for the total hot drying time requirement for the dryer load. This is done by using the keypad 18-C on the front of controller 18-A. This is followed by acknowledgement on the LCD 18-B that the drying time is set. The LCD then prompts the user to enter a time for cool air fluff; this cool cycle reduces the tendancy for the clothes to wrinkle. Thus, the three simple actions by the operator, to turn the start knob, time the heat dry cycle, and to time the cool cycle are all that is required. The dryer will now proceed automatically. If the furnace is on during the programming the thermistor heat sensor 73 will immediately start the dryer's cycling upon programming completion. If the furnace is between heat cycles the dryer will not start until a heat cycle initiates the start. Thermistor 73 with its relay circuit starts an internal countdown timer to complete the programmed time requirement. The thermistor 73 relay circuit also energizes the triac gate in the dual solid state relay and starts and stops the dryer motor as required to synchronize the dryer to each heat cycle. This switching on and off of the dryer's motor is a parallel motor starting circuit. It does not, by design, interfere with the dryer's circuitry or controls. The dryer will thus cycle on and off with each successive furnace heat cycle until the drying timer has reached zero. When the end of the drying cycle is reached the magnet 76 is de-energized allowing the damper 70 to drop to its horizontal normally off position. Since the DPST start switch energized the controller's main circuit with a latching switch the overall power remains on even though this switch has opened. Simultaneously the dryer motor's function is transferred to the cool fluff cycle to run to the end of that preset time. With damper 70 in its off position, ambient room air enters the invention through the bottom opening 66 and doubles back down through opening 68 and through duct 38 into the dryer. The air is circulated through the clothing and exhausted to the furnace cold air duct for circulation throughout the home.

The operation of the invention with waste hot air from an air conditioner is generally the same as with furnace source. The hot exhaust position of duct 56 can be capped if not used. In intermediate climate areas where both furnace and air conditioning units may be present in a home central air system both exhaust connections are made.

It should be noted at this point that just as a furnace to dryer installation saves energy by only or preferably circulating indoor air, the same principle applies to the outdoor air when using waste heat from air conditioning. In the case of air conditioning, air is ducted into the dryer from the outdoors and exhausted again to the outdoors. The home's interior air is not influenced by the use of the dryer. Therefore, no interior air is lost to exhaust by the dryer. This saves electrical energy in two modes. Replacement infiltrated air does not have to be cooled as in the normal use of a dryer. Also, the cool air of a home does not have to be heated by the electric elements of a dryer to again reach the temperature of the outdoors, in reference to the infiltrated air. Air conditioning affords about a three to one efficiency gain while cooling the infiltrated air to the home's temperature but then the air must also regain the level of the outdoor temperature by electric heating in the dryer. so, on an hourly use basis about one and one quarter kilowatt hours are waste usage. By installing a duct and hood for use of the waste air conditioner heat, the duct will also serve to provide outdoor ambient air between cooling cycles or even on cooler days and still save considerable amounts of energy.

SUMMARY OF THE INVENTION

The invention is a retro-fit device that future dryer design generations can very easily incorporate. The invention can potentially maintain energy savings for all existing electric dryers now in use, and then continue on into the new dryer generational designs into the future. The total impact has tremendous potential. There are over seventy-five million electric dryers now in use in the U.S. and Canada and with the invention average savings per a statistical household can be over seven hundred and fifty kilowatt hours per year.

I claim:

1. An energy conservation coupler for use in combination with an electric clothes dryer, said coupler consisting of a box attached to said clothes dryer, said box including a top wall section having a first hot air inlet, a first exhaust outlet and a second exhaust outlet, a second bottom wall section, parallel to said first wall section, having a first exhaust inlet, an ambient air inlet and a dryer exhaust inlet, said box further including a flexible duct exhaust selector having two ends, a first end permanently connected to said first exhaust inlet and a second end positionable via a sliding plate which is attached to and surrounds said second end, into either a first position wherein the second end of the duct communicates with the first exhaust outlet or a second position wherein the second end communicates with the second exhaust outlet, said box further including a damper plate pivotable on a damper mounting shaft between two positions, a first damper position parallel to and between said top and bottom wall sections and a second damper position perpendicular to said wall sections, said damper lockable in said second damper position by an electromagnet mounted on a partition wall which is perpendicular to the top and bottom wall sections and which partially closes off air flow between the first hot air inlet and the first exhaust outlet, said second damper position stopping all air flow between the first hot air inlet and the first exhaust outlet while directing all air flow between said hot air inlet and said dryer exhaust inlet, said first damper position blocking air flow between said hot air inlet and said dryer exhaust inlet and allowing air flow from said dryer exhaust into said ambient air inlet.

2. The conservation coupler of claim 1 wherein a microswitch is mounted on the partition wall to actuate the electromagnet.

3. The conservation coupler of claim 2 wherein an electronic controller is attached to the box and is operable to control the actuation of the microswitch and thereby control the position of said damper plate.

4. The conservation coupler of claim 3 wherein the sliding plate includes a control tab extending at a right angle to the plate and outside the top wall section, said control tab slidable within a slot to position the plate.

5. The conservation coupler of claim 4 including a knob attached to an end of the damper mounting shaft on an outside wall of the box which is perpendicular to said top and bottom wall sections, said knob rotatable to initially position the damper plate.

* * * * *